US008115144B2

(12) United States Patent
Cassani et al.

(10) Patent No.: US 8,115,144 B2
(45) Date of Patent: Feb. 14, 2012

(54) METHOD FOR CONTROLLING THE OPERATION OF A GLOW-PLUG IN A DIESEL ENGINE

(75) Inventors: Stefano Cassani, Turin (IT); Andrei Kanev, Turin (IT)

(73) Assignee: GM Global Technology Operations LLC, Detroit, MI (US)

( * ) Notice: Subject to any disclaimer, the term of this patent is extended or adjusted under 35 U.S.C. 154(b) by 447 days.

(21) Appl. No.: 12/470,308

(22) Filed: May 21, 2009

(65) Prior Publication Data

US 2009/0289051 A1 Nov. 26, 2009

(30) Foreign Application Priority Data

May 21, 2008 (EP) ..... 08009374

(51) Int. Cl.
*H05B 1/02* (2006.01)

(52) U.S. Cl. ..... 219/497; 219/492; 219/494; 219/501; 123/145 A; 123/179.6; 701/113

(58) Field of Classification Search ..... 219/492, 219/497, 499, 501, 505; 701/113; 123/145 A, 123/179.6
See application file for complete search history.

(56) References Cited

U.S. PATENT DOCUMENTS

| | | | |
|---|---|---|---|
| 4,487,169 | A | 12/1984 | Slezak et al. |
| 4,669,430 | A | 6/1987 | Reinhold et al. |
| 6,148,258 | A | 11/2000 | Boisvert et al. |
| 2010/0312416 | A1 | 12/2010 | Demirdelen |

FOREIGN PATENT DOCUMENTS

| | | | |
|---|---|---|---|
| DE | 102006010083 | A1 | 6/2007 |
| DE | 102009024138 | A1 | 12/2010 |
| EP | 0035407 | A2 | 9/1981 |
| GB | 2159578 | A | 12/1985 |
| GB | 2472811 | A | 2/2011 |
| JP | 2004100521 | A | 4/2004 |
| JP | 2004232503 | A | 8/2004 |
| WO | 2011107345 | A1 | 9/2011 |

*Primary Examiner* — Mark Paschall
(74) *Attorney, Agent, or Firm* — Ingrassia Fisher & Lorenz, P.C.

(57) ABSTRACT

A method is provided that includes, but is not limited to estimating the temperature (TGP,est) of the glow-plug (GP) in accordance with a first model of the glow-plug (GP) as a function of the detected values of the glow-plug voltage and current (VGP, IGP) and the sensed values of some input variables, such as the engine speed (ωE) and the engine temperature (TE), determining, in accordance with a second predetermined model of the glow-plug (GP), a desired value of the voltage (VGP,des) or power (PGP,des) to be supplied to the glow-plug (GP), as a function of a desired value of the glow-plug temperature (TGP,des), the estimated glow-plug temperature (TGP,est), and the sensed values of the input variables, and varying the duty-cycle of a pulse-width-modulated voltage (VPWM) applied to the glow-plug (GP), as a function of the calculated value of said desired voltage (VGP, des) or power (PGP,des).

5 Claims, 1 Drawing Sheet

METHOD FOR CONTROLLING THE OPERATION OF A GLOW-PLUG IN A DIESEL ENGINE

CROSS-REFERENCE TO RELATED APPLICATION

This application claims priority to European Patent Application No. 08009374.3, filed May 21, 2008, which is incorporated herein by reference in its entirety.

TECHNICAL FIELD

The present invention relates to a method for controlling the operation of glow-plugs in a Diesel internal combustion engine. More specifically, the present invention relates to a method for controlling the operation of a glow-plug driven by means of a pulse-width-modulated (PWM) voltage applied thereto.

SUMMARY

With motor-vehicles having a Diesel internal combustion engines, users generally require fast ignition and smooth engine operation, even in adverse ambient conditions, particularly at low temperatures. Furthermore, increasingly tight regulations require reduced exhaust emissions.

The key component used to meet the above-outlined requirements is the glow-plug. Glow-plugs are fitted in the combustion chamber of each engine cylinder, and are heated up to very high temperatures, generally above about 900° C. A method of controlling glow-plugs in a Diesel internal combustion engine of the initially defined kind is disclosed for instance in U.S. Pat. No. 6,148,258.

The present invention is directed specifically to control glow-plugs of the so-called low-voltage type, i.e. glow-plugs having a nominal supply voltage which is lower (for instance 4V) than the vehicle battery voltage (typically 12V).

In known control systems of this kind the vehicle battery voltage is generally lowered by means of pulse-width-modulation (PWM), which on one hand allows to easily achieve the reduced nominal supply voltage for the glow-plugs, and on the other hand allows an easy variation of said supply voltage in particular operating conditions, such as at engine start-up, when a supply voltage higher than the nominal voltage allows to speed-up the glow-plug heating phase. Pulse-width-modulation also allows to vary the glow-plug supply voltage with the engine running, in accordance to the current engine operating conditions and environmental conditions, in order to keep the glow-plug temperature as close as possible to a desired temperature value, and to compensate the effect of fluid flow inside the combustion chamber which generally tends to cool down the glow-plug.

It is at least one object of the present invention to provide an improved method of controlling, in a Diesel internal combustion engine, the operation of a glow-plug of the initially defined kind. In addition, other objects, desirable features, and characteristics will become apparent from the subsequent summary and detailed description, and the appended claims, taken in conjunction with the accompanying drawings and this background.

BRIEF DESCRIPTION OF THE DRAWINGS

The present invention will hereinafter be described in conjunction with the following drawing FIGURE, and The single FIGURE illustrates a glow-plug fitted in the combustion chamber of a cylinder of a Diesel combustion engine is generally indicated GP.

DETAILED DESCRIPTION

Figure 1:
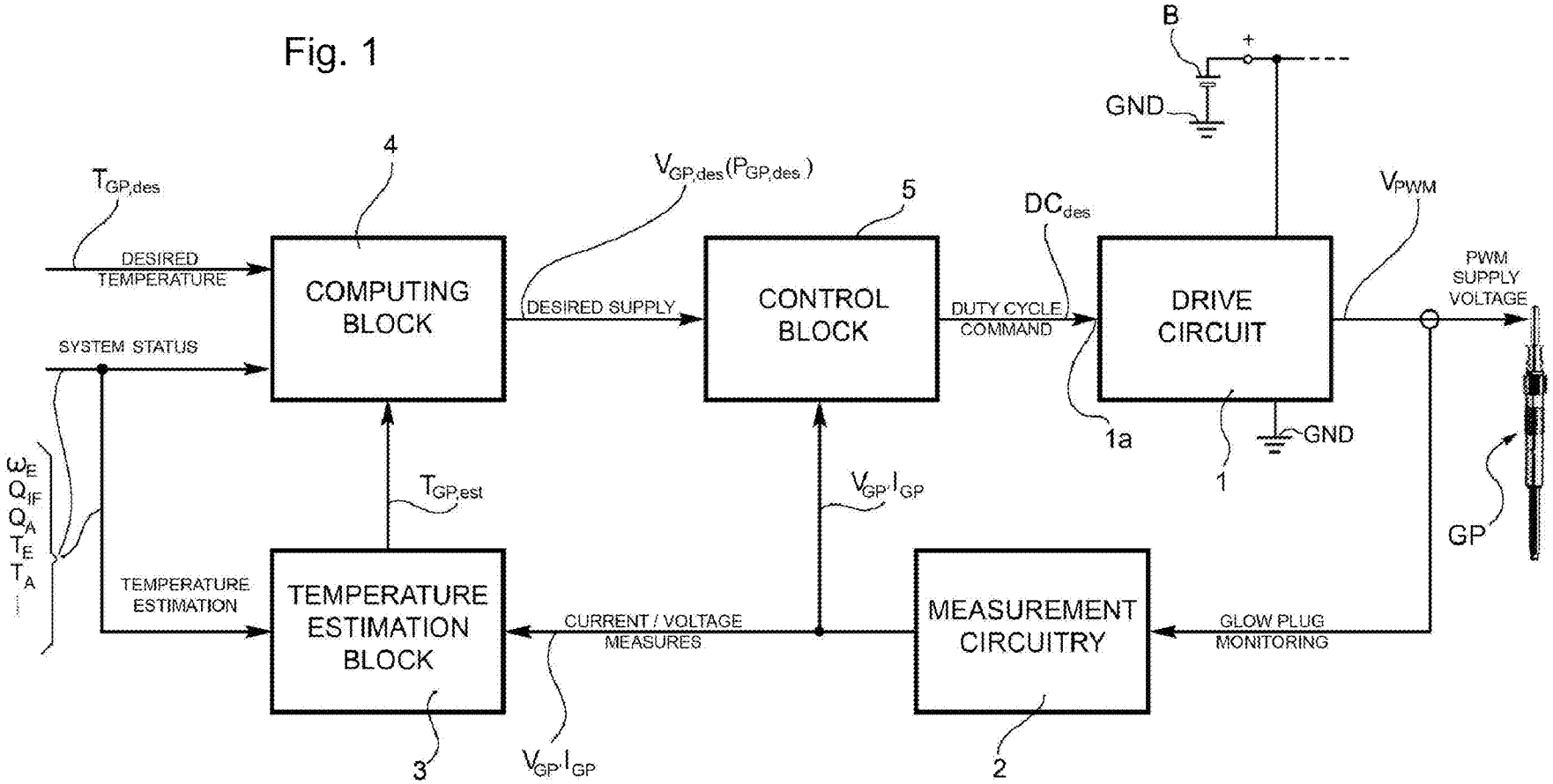

The following detailed description is merely exemplary in nature and is not intended to limit application and uses. Furthermore, there is no intention to be bound by any theory presented in the preceding background and summary of the following detailed description.

In a per se known manner, the drive circuit 1 includes at least one switch, such as a MOSFET transistor, and is arranged to apply to the glow-plug GP a pulse-width-modulated (PWM) voltage, indicated VPWM in FIG. 1. Glow-plug GP is of a per se known kind, and will not be described in details. The operation of the glow-plug GP is controlled by means of a drive circuit 1 which is coupled to the vehicle battery B. The drive circuit 1 has a control input 1*a* for receiving a control signal.

The control signal DC,des applied to the control input 1*a* of the drive circuit 1 is indicative of the desired value of the duty-cycle (DC) of the PWM voltage VPWM to be applied to the glow-plug GP. A measurement circuitry 2 is coupled to the glow-plug GP and/or the drive circuit 1, and provides at its output signals or data indicative of the actual voltage VGP across the glow-plug GP the current IGP flowing through said glow-plug.

The output of the measurement circuitry 2 is coupled to a first input of an estimation block 3, which at further inputs receives signals or data indicative of the values of a number of input variables including the engine speed ωE, the engine temperature TE, the ambient air temperature TA, the quantity QIF of fuel injected into the engine cylinder to which the glow-plug GP is associated, and the quantity QA of air supplied to the engine cylinder.

The estimation block 3 is predisposed to estimate the actual current temperature TGP,est of the glow-plug GP in accordance with a first, predetermined, mathematical model of the glow-plug in the corresponding combustion chamber of the engine cylinder, as a function of the detected values of the glow-plug voltage VGP and current IGP and the sensed values of the said input variables. The model may be for instance in the form of a multi-variable look-up table. The output of the glow-plug temperature estimation block 3 is coupled to an input of a computing block 4 which at another input also receives the values of the above-mentioned input variables (ωE, TE, TA, QIF, etc.).

The computing block 4 has a further input for receiving signals or data indicative of the desired glow-plug temperature TGP,des. The computing block 4 is arranged to determine, in accordance with a second predetermined model of the glow-plug GP in the combustion chamber, a desired value of the voltage VGP,des or the electric power PGP,des to be supplied to the glow-plug GP, as a function of the estimated temperature TGP,des of the glow-plug GP, the desired value TGP,des of the temperature of the glow-plug, and the sensed values of the input variables.

The computing block 4 can include a so-called governor which, on the basis of a set point value (i.e. the desired glow-plug temperature TGP,des) and a feedable value (i.e. the estimated glow-plug temperature TGP,est), determines the output value (i.e. the desired supply voltage VGP,des or power PGP,des). Such a governor is arranged to use the mathematical model of the glow-plug GP as a "feedforward" term (i.e., as a first "guess" of desired voltage (or power) supply based on the set point value), the term being then corrected as a function of the difference between the set point value and the feedback value (i.e., as a function of the so-called tracking error). The output of the computing block 4 is coupled to an input of a control block 5 which at another input receives signals or data indicating the detected glow-plug voltage VGP and current IGP.

The control block 5 is arranged to calculate, by means of a suitable algorithm, the value of the duty-cycle DCdes of the PWM voltage VPWM to be applied to the glow-plug GP, as a predetermined function of the calculated value of said desired voltage VGP,des or power PGP,des to be supplied to the glow-plug.

The foregoing allows to achievement of a more accurate and flexible control of the temperature of the glow-plug, which in turn involves the following main benefits: the quality of the combustion at low temperature is improved, and the engine can be more easily started, whereas exhaust emissions are appreciably reduced. The foregoing also allows the achievement of reducing possible damages to the glow-plugs, whereby their lifetime can be significantly increased.

Naturally, the principle of the invention remaining the same, the forms of embodiment and details of construction may be varied widely with respect to those described and illustrated purely by way of non-limiting example, without thereby departing form the scope of the invention as defined in the appended claims. Moreover, while at least one exemplary embodiment has been presented in the foregoing summary and detailed description, it should be appreciated that a vast number of variations exist. It should also be appreciated that the exemplary embodiment or exemplary embodiments are only examples, and are not intended to limit the scope, applicability, or configuration in any way. Rather, the foregoing summary and detailed description will provide those skilled in the art with a convenient road map for implementing an exemplary embodiment, it being understood that various changes may be made in the function and arrangement of elements described in an exemplary embodiment without departing from the scope as set forth in the appended claims and their legal equivalents.

What is claimed is:

1. A method of controlling, in a Diesel internal combustion engine, an operation of a glow-plug (GP) that is driven with a pulse-width-modulated voltage (VPWM) applied thereto, the method comprising the steps of:

detecting a glow-plug voltage (VGP) and a glow-plug current (IGP);

sensing a number of predetermined engine and environmental input variables comprising an engine speed (ωE), an engine temperature (TE), and an ambient air temperature (TA); and varying a duty-cycle (DC) of the pulse-width-modulated voltage (VPWM) applied to the glow-plug (GP) in dependence upon the glow-plug voltage (VGP) and the glow-plug current (IGP) and sensed values of the environmental input variables, wherein an actual current temperature (TGP,est) of the glow-plug (GP) is estimated in accordance with a first predetermined model of the glow-plug (GP) in a corresponding combustion chamber as a function of detected values of the glow-plug voltage (VGP) and the glow-plug current (IGP) and the sensed values of the environmental input variables, wherein at least one of the glow-plug voltage (VGP,des) or an electrical power (PGP,des) to be supplied to the glow-plug (GP) is determined in accordance with a second predetermined model of the glow-plug (GP) in a combustion chamber as a function of an estimated temperature (TGP,est) of the glow-plug (GP), and the sensed values of said environmental input variables, and wherein the duty-cycle (DC) of the pulse-width-modulated voltage (VPWM) applied to the glow-plug (GP) is varied in a predetermined manner as a function of a calculated value of at least one of the glow-plug voltage (VGP,des) or a power (PGP,des) to be supplied to the glow-plug (GP).

2. The method of claim 1, wherein the said pulse-width-modulated voltage (VPWM) applied to the glow-plug (GP) is obtained by switching on and off a voltage supplied by a battery (B) associated with the Diesel internal combustion engine.

3. The method of claim 1, wherein the duty-cycle (DC) of the pulse-width-modulated voltage (VPWM) applied to the glow-plug (GP) is varied also as the function of detected values of the glow-plug voltage (VGP) and glow-plug current (VGP, IGP).

4. The method of claim 1, wherein said environmental input variables further comprise a quantity of fuel (QIF) injected into an engine cylinder to which the glow-plug (GP) is associated, and a quantity of air (QA) supplied to said engine cylinder.

5. The method of claim 1, wherein a desired value of the glow-plug voltage (VGP,des) or the electrical power (PGP, des) to be supplied to the glow-plug (GP) is determined by means of a governor using a desired glow-plug temperature (TGP,des) as a set point value, an estimated glow-plug temperature (TGP,est) as a feedback value, and a predetermined model of the glow-plug (GP) as a feedforward term for determining an initial value for a voltage or a power to be supplied to the glow-plug (GP), said initial value being corrected as a function of a difference between said set point value (TGP, des) and the feedback value (TGP,est).

* * * * *